United States Patent [19]

Burwasser

[11] Patent Number: 4,474,850

[45] Date of Patent: Oct. 2, 1984

[54] INK JET RECORDING TRANSPARENCY

[75] Inventor: Herman Burwasser, Boonton, N.J.

[73] Assignee: Transcopy, Inc., New York, N.Y.

[21] Appl. No.: 547,794

[22] Filed: Nov. 2, 1983

[51] Int. Cl.[3] ..... B41M 5/00

[52] U.S. Cl. ..... 428/336; 346/135.1; 428/195; 428/206; 428/323; 428/331; 428/480; 428/483

[58] Field of Search ..... 346/1.1, 135.1; 400/126; 427/261, 288; 428/207, 211, 537, 195, 206, 323, 331, 336, 480, 483, 500, 411

[56] References Cited

U.S. PATENT DOCUMENTS

| | | | |
|---|---|---|---|
| 4,269,891 | 5/1981 | Minagawa | 428/335 |
| 4,308,542 | 12/1981 | Maekawa et al. | 346/1.1 |
| 4,371,582 | 2/1983 | Sugiyama et al. | 428/341 |

*Primary Examiner*—Bruce H. Hess
*Attorney, Agent, or Firm*—Walter Katz

[57] ABSTRACT

A novel and useful ink jet recording transparency is described herein which is capable of wetting and absorbing colored, water soluble inks to provide permanent, high density images which are smear resistant. The transparency article of the invention includes a transparent resinous support which has a defined coating thereon. The coating is clear and consists essentially of a carboxylated, high molecular weight polymer or copolymer, or salts thereof, and, optionally, a pigment which is a particulate material. In the preferred embodiment of the invention, wherein high density images may be formed on a coated transparency from multiple jets of different colored inks which absorb such inks rapidly, the coating includes a carboxylated acrylic polymer which has been reacted with an organic amine.

10 Claims, No Drawings

INK JET RECORDING TRANSPARENCY

BACKGROUND OF THE INVENTION

1. Field of the Invention

This invention relates to a recording sheet for use in an ink jet recording process, and, more particularly, to a transparency recording sheet in which images formed thereon from colored ink jets are of high density and smear resistant.

2. Description of the Prior Art

Ink jet machines for high speed recording of information, e.g. from computer terminals, have become widely used in the art. Such machines are described in detail in U.S. Pat. Nos. 4,390,883; 4,390,886 and 4,392,141. Ink jet compositions suitable for use in such machines are described in U.S. Pat. Nos. 4,155,768; 4,176,361; and 4,197,135. Ink jet recording sheets for such machines are described in U.S. Pat. Nos. 3,889,270; 4,269,891; 4,308,542; and 4,371,582. Generally, these patents are concerned with providing paper sheets on which ink jet recording can produce high quality copies. The use of ink jet printing for achieving recording on plastic transparencies, however, has been largely unsuccessful, because the transparent polyester film support repels aqueous ink solutions. Accordingly, high density images which are smear resistant cannot be obtained on uncoated polyester film.

SUMMARY OF THE INVENTION

Therefore, it is an object of this invention to provide an ink jet recording transparency which is capable of wetting and absorbing colored, water soluble inks to provide high density images which are smear resistant under normal use.

This object and other objects of the invention are realized herein by the provision of an ink jet recording transparency which is constructed of a transparent resinous support and a clear coating thereon which coating is composed of a carboxylated, high molecular weight polymer or copolymer, and salts thereof, and, optionally, a pigment which is a particulate material. In the preferred embodiments of the invention, the polymer used in the coating is an amine salt of a carboxylated acrylic resin, and the particulate matter is a synthetic silica.

DETAILED DESCRIPTION OF THE INVENTION

The ink jet recording transparency of the invention includes a transparent resin as the base, generally thermoplastic films, such as polyester (e.g. polyethylene terephthalate, such as Mylar 400PB made by duPont), polystyrene, polyvinyl chloride, polymethylmethacrylate, cellulose acetate and the like. The thickness of the resin film base is not restricted to any special range although usually the film has a thickness of about 2 to 10 mils.

The coating formulation of the invention includes a carboxylated, high molecular weight polymer or copolymer, and salts thereof, particularly monomers of acrylic or methacrylic acid, and esters thereof; vinyl acetates; or styrenated acrylics. Usually the molecular weight of the polymer or copolymer ranges from about 50,000 to 1 million. The polymer may contain other substituents in addition to carboxyl groups, such as hydroxyl, ester or amino groups as long as the wettability property of the polymer is retained, and its ionic nature is sufficient to absorb the dye component of the ink.

In the preferred embodiments of the invention, the carboxyl group of the polymer is reacted with a base, preferably an organic amine, or an inorganic hydroxide. Typical organic amines which may be used for this purpose include methanolamine, ethanolamine, di- and trimethyl and ethanolamine, methyl ethyl and di- and trimethyl and ethyl amine. Inorganic hydroxides include sodium hydroxide, potassium hydroxide and the like.

The carboxylated polymer may be reacted either wholly or partially. Preferably about 5–50% by weight of the organic amine, e.g. triethanolamine, based upon the dry weight of the polymer, and, optimally, about 15%, at a predetermined thickness of the coating, will provide a coating having excellent dye absorbancy.

The thickness of the coatings used herein generally range from about 2–15 microns. Such thicknesses will accommodate dyes of varying concentrations which can be delivered to the transparency at high rates of delivery and with accompanying high dye absorbtivity in the coating.

The rate of drying of the image may be improved substantially by including a small amount of a pigment in the coating. The pigment preferably is a synthetic particular material, such as a silica, although other particulate materials, such as calcium carbonate, kaolin clay, zinc oxide, aluminate sulfate and the like also may be used. A preferred particulate material is synthetic silica having an average diameter of about 1–25 microns, preferably about 10 microns. When present in the coating formulation, the silica to polymer ratio usually is about 0.02 to 0.5, preferably about 0.1. The upper limit of this ratio is set by the transparency requirement of the film. A very useful coating composition is a blend of the carboxylated acrylic polymer partially reacted with triethanolamine and containing silica as the particulate matter.

The dyes used herein to form images on the coating are usually water soluble color index acid, direct and reactive dyes containing anionic sulfonic acid groups, and basic dyes which contain cationic sites. These dyes, with their polar substituents, upon contacting the carboxyl or ester substituents of the coating layer, are rapidly locked onto the surface by an ionic interaction, which enhances color density, while the remaining ink solvent is rapidly eluted down into the remaining portions of the layer, where it can begin to dry.

To test the quality of the recording material, two methods were used. In the first method, an ink jet transparency was prepared containing the coating of the invention, and a series of colored inks were ejected vertically onto the transparency. The resultant colored image, its absorbancy or color density, degree of spreading of the color image, and rate of drying, as evidenced by smear resistance after a given period of time, was observed. In the second method, a commercial ink jet printer was used and the same physical characteristics of the imaged transparency were observed and measured.

The following examples are given to illustrate the invention in greater detail.

EXAMPLE 1

100 g. of a carboxylated acrylic polymer (National Starch 78-3955) was dissolved in 200 g. of isopropanol to form a stock solution. To 50 g. of the stock solution was added 1.25 g. of synthetic silica particles (Syloid Silica A1-I—W. R. Grace) and the mixture was stirred to uniformity. The resulting mixture was then coated onto a 4.0 mil transparent polyester film with a #13 wire bar and air dried. The coating was 4 microns thick.

To the coated polyester film was projected vertically four color inks of cyan, magenta, yellow and black simulating an ink jet recording process, to obtain a multicolor recording on the film. The applied inks were observed to flow smoothly on the film and to form well defined colored image, which absorbed easily into the coating, dried rapidly and was smear resistant.

EXAMPLE 2

The procedure of Example 1 was repeated except that 2.5 g. of silica was included in the coating mixture. The results were comparable to that of Example 1.

EXAMPLE 3

50 g. of carboxylated acrylic resin NS 3955, 100 g. of isopropanol and 2.5 g. of triethanolamine (9% based on weight of resin) was admixed to form a coating solution which was applied to a 4 mil polyester film and dried to form a continuous coating having a thickness of 10 microns.

A succession of four different color inks then was projected onto the coated film and the inks allowed to run down across the film. The degree of absorbtivity, color generation or density, rate of drying of the ink, and degree of smear resistance was observed for each ink used. The results showed that exceedingly high density colored images were formed, with little image spreading, good drying, and with accompanying smear resistance.

EXAMPLE 4

The procedure of Example 3 was repeated using increasing amounts of triethanolamine at coating thicknesses between 2–15 microns. The optical density of the resulting color tracks generated by projecting colored ink jets onto the polyester films was measured and the rate of drying observed. The results showed that the absorbtivity of the ink onto the coating was higher than that found in Example 1, resulting in higher optical density readings. The optimum optical density was reached at about 4.8 g. of triethanolamine (16.7%).

EXAMPLE 5

The experiments of Examples 1–3 were repeated using a commercial Tektronix 4691 color copier. The colored inks used were those recommended and made available for this machine by the manufacturer. Similar results were obtained for image properties as in the laboratory tests.

While the invention has been described in detail and with reference to specific embodiments thereof, it will be apparent to one skilled in the art that various changes and modifications can be made without departing from the spirit and scope thereof.

What is claimed is:

1. An ink jet recording transparency capable of being wetted by and absorbing colored, water soluble inks to provide high density images which are smear resistant comprising:

(a) a substantially transparent resinous support, and (b) a substantially clear coating thereon which includes a carboxylated, high molecular weight polymer or copolymer, or salts thereof.

2. An ink jet recording transparency according to claim 1 in which said resinous support is a transparent polyester film.

3. An ink jet recording transparency according to claim 1 in which said carboxylated high molecular weight polymer is an acrylic or methacrylic polymer or copolymer having a molecular weight of from 50,000 to one million.

4. An ink jet recording transparency according to claim 1 which includes a pigment particulate material which is present in an amount such that the pigment to polymer ratio by weight is about 0.02 to 0.5.

5. An ink jet recording transparency according to claim 1 in which said coating contains an amine salt of a carboxylated acrylic polymer.

6. An ink jet recording transparency according to claim 1 in which said coating has a thickness of about 2–15 microns.

7. An ink jet recording transparency according to claim 1 in which said coating contains a triethanolamine salt of a carboxylated acrylic polymer or copolymer.

8. An ink jet recording transparency according to claim 1 comprising: a transparent polyester film support, and a clear coating thereon consisting essentially of a carboxylated acrylic or methacrylic polymer or copolymer having a molecular weight of from 50,000 to 1 million, and amine salts thereof and the thickness of the coating is about 2–15 microns

9. An ink jet recording transparency according to claim 8 which includes a pigment particulate material which is a synthetic silica having an average diameter of about 2–10 microns and in which the pigment to polymer ratio is about 0.02 to 0.5.

10. An ink jet recording transparency according to claim 9 wherein the amine salt is triethanolamine which is present in an amount of less than about 50% by weight of the carboxylated acrylic or methacrylic polymer.

* * * * *